United States Patent [19]

Schmidt et al.

[11] Patent Number: 4,594,834

[45] Date of Patent: Jun. 17, 1986

[54] CONTAINER STUFFING APPARATUS AND METHOD

[75] Inventors: Richard Schmidt, Ambler, Pa.; Joseph A. Pizzo, Sr., Cherry Hill, N.J.

[73] Assignee: Enviro-Spray Systems Incorporated, Montgomeryville, Pa.

[21] Appl. No.: 704,595

[22] Filed: Feb. 25, 1985

[51] Int. Cl.[4] ..... B65B 63/02; B65B 63/04

[52] U.S. Cl. ..... 53/117; 53/118; 53/529

[58] Field of Search ..... 53/117, 529, 118; 292/DIG. 3

[56] References Cited

U.S. PATENT DOCUMENTS

| | | | |
|---|---|---|---|
| 3,563,168 | 2/1971 | Doninger | 53/529 |
| 3,576,162 | 4/1971 | McBrady | 53/529 |
| 3,927,504 | 12/1975 | Forrister | 242/DIG. 3 |
| 4,376,500 | 3/1983 | Banks | 53/570 |

FOREIGN PATENT DOCUMENTS

| | | | |
|---|---|---|---|
| 2084954 | 4/1982 | United Kingdom | 53/529 |

*Primary Examiner*—John Sipos

*Attorney, Agent, or Firm*—Kenyon & Kenyon

[57] ABSTRACT

Container stuffing apparatus and methods are disclosed. The apparatus is especially useful for the insertion of two component gas generating pouches into containers of the type wherein the pressurizing gas does not come into contact with the contents of the container. The apparatus receives the pouches, performs necessary bursting operations to initiate gas pressurization, compresses the pouch into an elongate cylindrical shape and inserts the pouch into a container. The apparatus includes a bursting station which comprises first and second plates having recesses which move toward each other and compress a pouch received between the first and second plates to thereby burst a rupturable member within the pouch to initiate gas generation and direct the gas generating components toward each other. A reciprocable latch is provided to hold the pouch in position during the bursting operation. Furthermore, a projection on one of the plates and a recess on the other plate provides a bend along one edge of a pouch to thereby facilitate the deformation of the pouch into an elongate shape prior to insertion into a container. Additionally, an air pressure jet is provided to force the pouch, during the step of deformation into an elongate shape, against a surface of a chamber in which the pouch is deformed. This also facilitates the proper deformation of the pouch into the cylindrical shape necessary for it to be inserted into a container.

36 Claims, 9 Drawing Figures

CONTAINER STUFFING APPARATUS AND METHOD

BACKGROUND OF THE INVENTION

The present invention relates to container stuffing apparatus and methods and more particularly to apparatus and methods for inserting expandable pouches into pressurizable containers of the type wherein the propellant gas is created by chemical reaction within the pouch after the pouch is inserted into the container, all without the propellant gas contacting the product or leaving the container. Expandable pouches of this type are described in U.S. Pat. No. 4,376,500 to Banks and Magid, owned by the assignee of the present application. A container stuffing device for expandable pouches of this type is described in application Ser. No. 398,887, filed July 16, 1982 now U.S. Pat. No. 4,531,341, also owned by the assignee of the present application. An automatic container stuffing device for expandable pouches of this type is described in application Ser. No. 570,376, filed Jan. 13, 1984, and also is owned by the assignee of the present application.

SUMMARY OF THE INVENTION

It is an object of the present invention to provide an improved apparatus and method for stuffing or inserting a flexible sheet product, such as a generally flat expandable pouch of the type described, prior to expansion, into a can or container.

It is a further object to provide an improved apparatus wherein pouches of the type described are deformed into an elongate shape and then inserted into a container.

It is yet a further object to provide an apparatus which provides improved means for activating and enhancing the generation of pressurizing gas within the expandable pouches just prior to the time that they are inserted into the containers.

It is still a further object to provide a portable apparatus which allows pouches of the type described to be shipped to a location where the apparatus may be located and then inserted into a container, the apparatus insuring that pressurization of the container occurs after insertion.

It is yet still a further object of the present invention to provide an improved apparatus for handling pouches of the type described without damaging the pouches prior to their deformation and insertion into a container.

These and other objects are achieved according to one aspect of the present invention by an apparatus for inserting flexible sheet products into containers, each of the products comprising an expandable pouch for pressurizing a container, the pouch including burstable means for generating pressurizing gas within the pouch, the apparatus comprising first plate means, second plate means extending parallel to and adjacent the first plate means and spaced apart therefrom, the sheet product being received between the first and second plate means, actuating means for relatively moving the first and second plate means toward each other so as to compress the flexible sheet product to burst the burstable means, means for deforming the sheet product into an elongate shape, the means for deforming comprising means having a generally flat internal chamber for receiving the flexible sheet product defined by first and second opposing surfaces and first and second ends, and pusher means mounted in the chamber extending along said first end and movable laterally toward and away from the second end, for deforming the flexible sheet product in the chamber into an elongate folded sheet product extending along the second end, the generally flat internal chamber having means for moving the flexible sheet product toward one of said opposing surfaces of the chamber while the pusher means deforms the flexible sheet product, and means for inserting the deformed sheet product into the container.

According to another aspect of the invention, the above objects are achieved by an apparatus for inserting flexible sheet products into containers, each of the products comprising an expandable pouch for pressurizing a container, the pouch including burstable means for generating pressurizing gas within the pouch, the apparatus comprising first plate means, second plate means extending parallel to and adjacent the first plate means and spaced apart therefrom, the sheet product being received between the first and second plate means, actuating means for relatively moving the first and second plate means toward each other so as to compress the flexible sheet product to burst the burstable means, means for bending an edge of the flexible sheet product so as to facilitate subsequent deformation of the sheet product into an elongate shape, means for deforming the sheet product into an elongate shape, the means for deforming comprising means having a generally flat internal chamber for receiving the flexible sheet product defined by first and second opposing surfaces and first and second ends, and pusher means mounted in the chamber extending along the first end and movable laterally toward and away from the second end, for deforming the flexible sheet product in the chamber into an elongate folded sheet product extending along the second end, and means for inserting the deformed sheet product into the container.

According to still another aspect of the invention, the above objects are achieved by an apparatus for inserting flexible sheet products into containers, each of the products comprising an expandable pouch for pressurizing a container, the pouch including burstable means for generating pressurizing gas within the pouch, the apparatus comprising first plate means, second plate means extending parallel to and adjacent the first plate means and spaced apart therefrom, the sheet product being received between the first and second plate means, actuating means for relatively moving the first and second plate means toward each other so as to compress the flexible sheet product to burst the burstable means, means for holding the pouch in an area between the first and second plate means comprising latch means laterally reciprocably movable into and out of a space adjacent a bottom edge of the first and second plate means, the latch means having a V-shaped slot therein for receiving a lower edge of the pouch and thereby holding the pouch between the first and second plate means when the first and second plate means move relatively toward each other, the latch means being movable away from the first and second plate means after the first and second plate means have moved away from each other to thereby allow the pouch to fall out of the area between the first and second plate means, means for deforming the sheet product into an elongate shape, the means for deforming comprising means having a generally flat internal chamber for receiving the flexible sheet product defined by first and second opposing surfaces and first and second ends, and pusher means mounted in the chamber extending along the first end and movable laterally toward and away from the second end, for deforming the flexible sheet product in the chamber into an elongate folded sheet product extending along the second end, and means for inserting the deformed sheet product into the container.

The invention also includes within its scope methods for inserting flexible sheet products into containers, as will be further described below.

Other objects, features and advantages of the present invention will be apparent from a reading of the detailed description which appears below.

BRIEF DESCRIPTION OF THE DRAWINGS

The present invention will be described in greater detail in the following detailed description with reference to the drawings in which.

DETAILED DESCRIPTION

Figure 1:
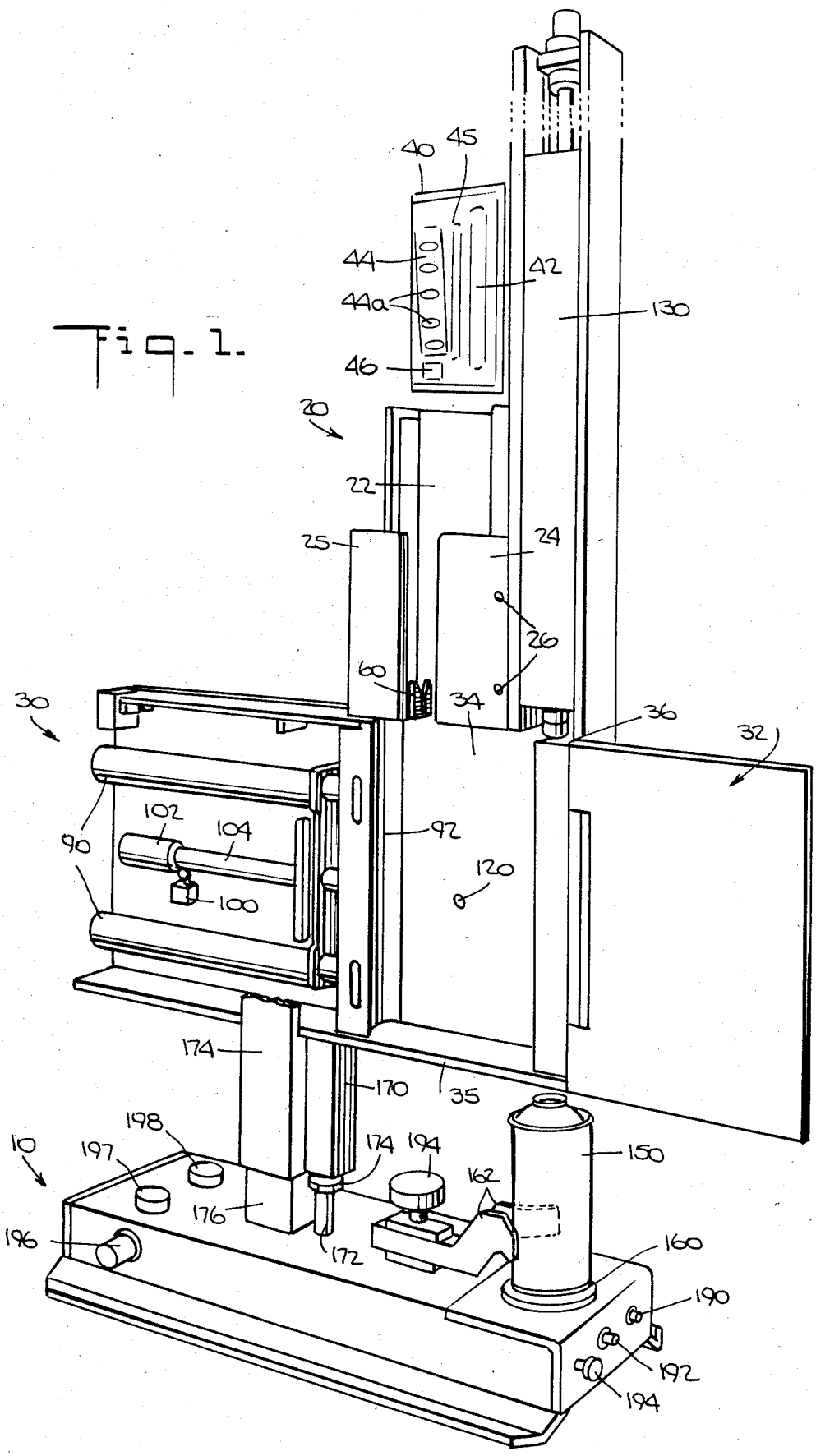
FIG. 1 is a front perspective view of an embodiment of the container stuffing apparatus according to the invention.
Figure 2:
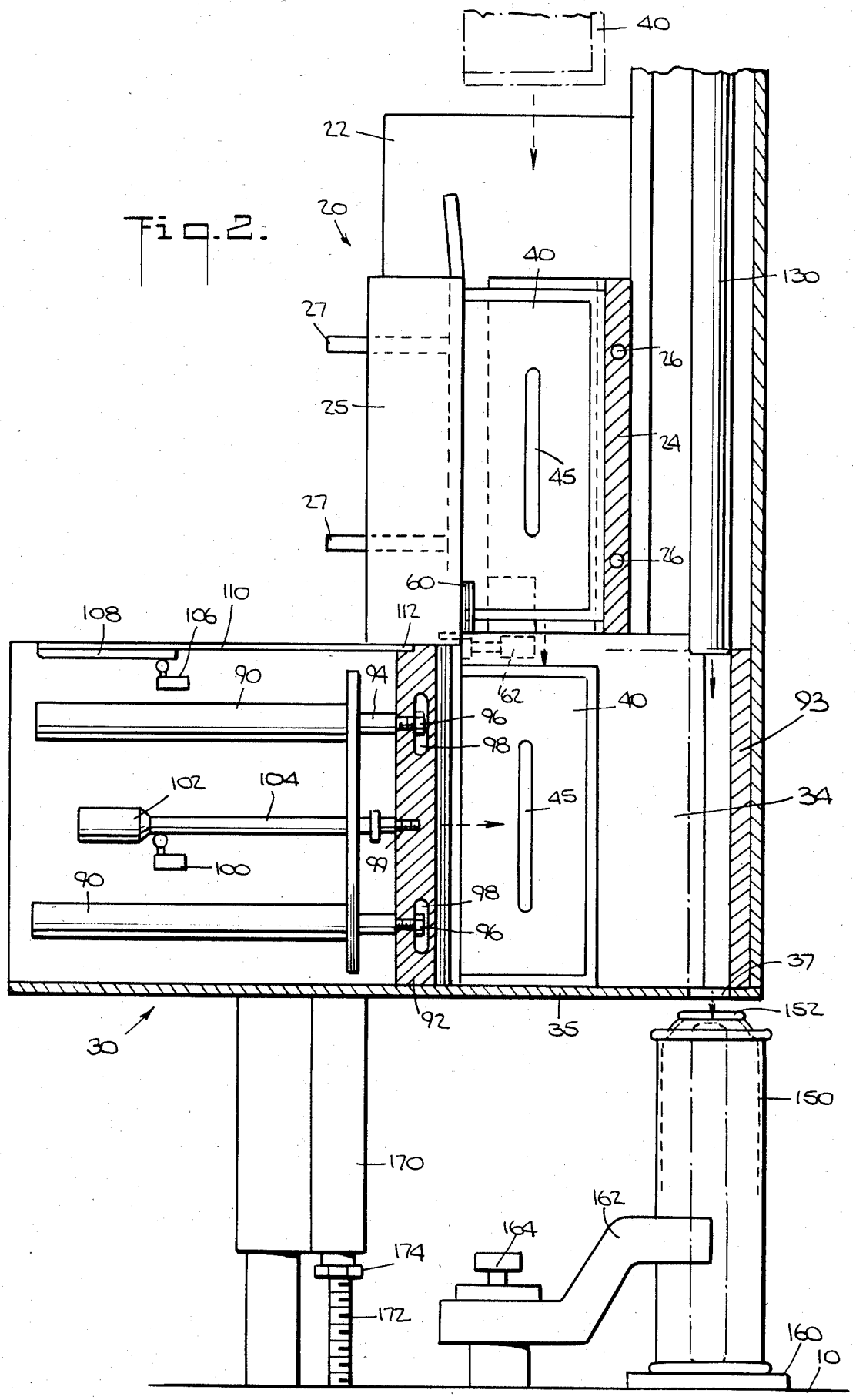
FIG. 2 is a front view of the apparatus shown in FIG. 1.

With reference now to the drawings and especially FIGS. 1 and 2, an embodiment of the container stuffing apparatus according to the invention is shown therein. The apparatus includes a preferably weighted base 10 which includes various controls, switches and adjustments for enabling operation of the device, to be described in more detail below. Base 10 also provides a convenient means for receiving a container 150 into which an expandable pouch is to be inserted. The apparatus further includes a pouch receiving station, indicated generally at 20, and a pouch deformation and insertion station indicated generally at 30. The pouch deformation and insertion station 30 includes a door 32 for allowing access to the pouch deformation and insertion chamber 34. Door 32 is hinged at 36 for allowing operator and/or service personnel access to the chamber 34.

Figure 3:
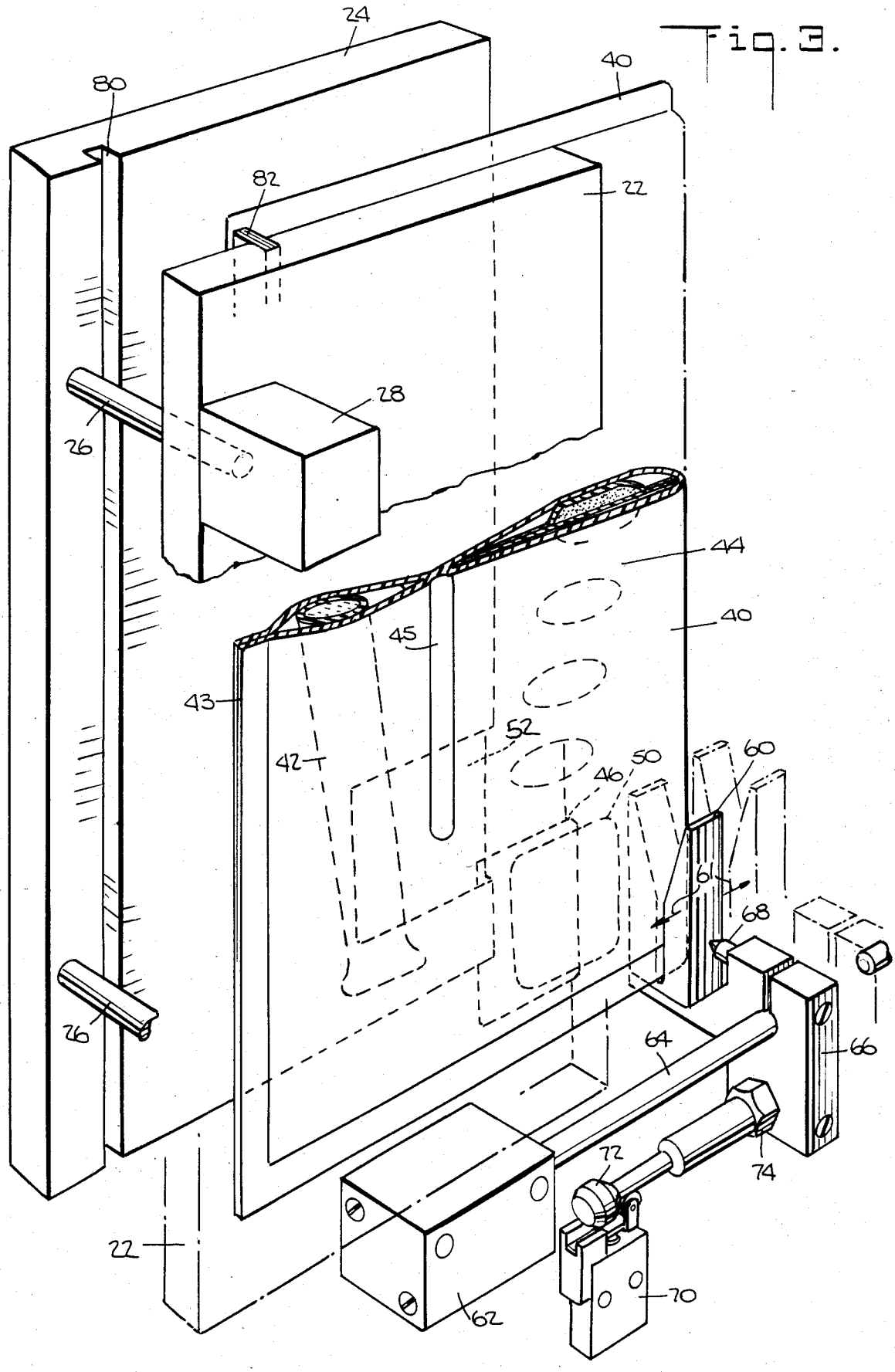
FIG. 3 is a perspective rear view of part of the apparatus shown in FIGS. 1 and 2 showing in a cutaway view the pouch bursting station.
Figure 4:
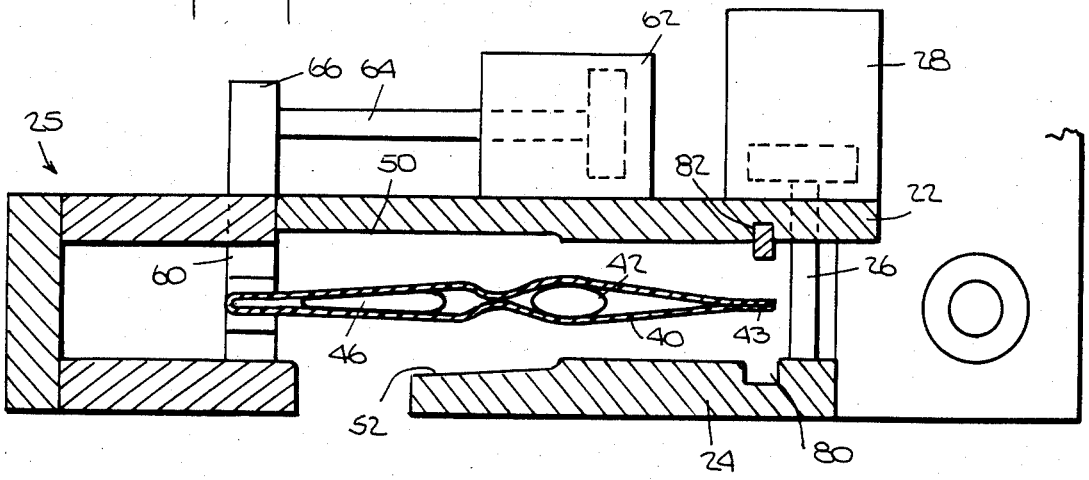
FIG. 4 is a top sectional view showing an expandable pouch in the bursting chamber just prior to bursting.
Figure 5:
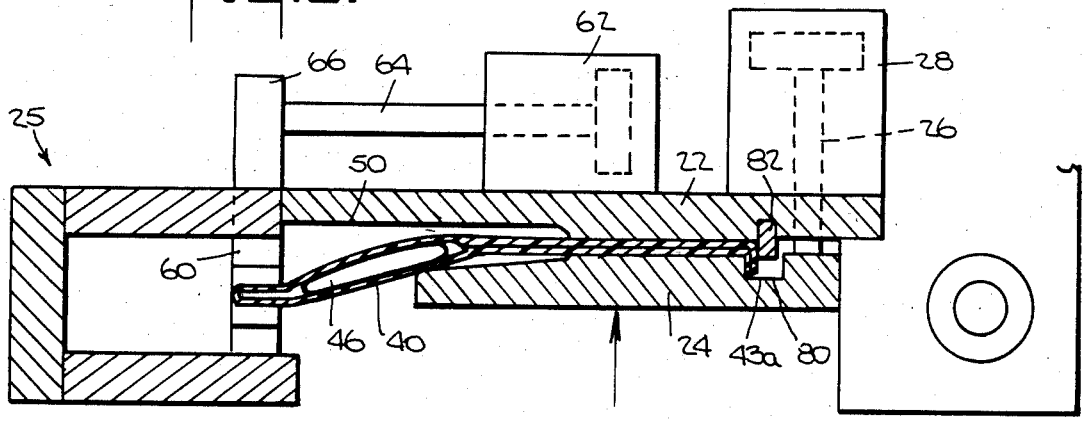
FIG. 5 is a view corresponding to FIG. 4 showing the expandable pouch during the bursting operation.
Figure 6:
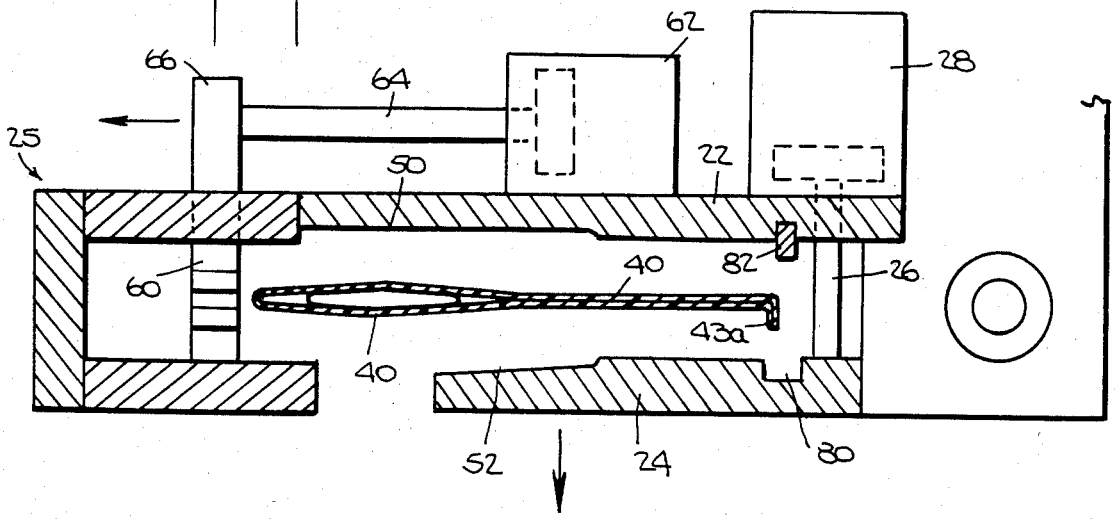
FIG. 6 is a view corresponding to FIGS. 4 and 5 showing the pouch just after the bursting operation.
Figure 7:
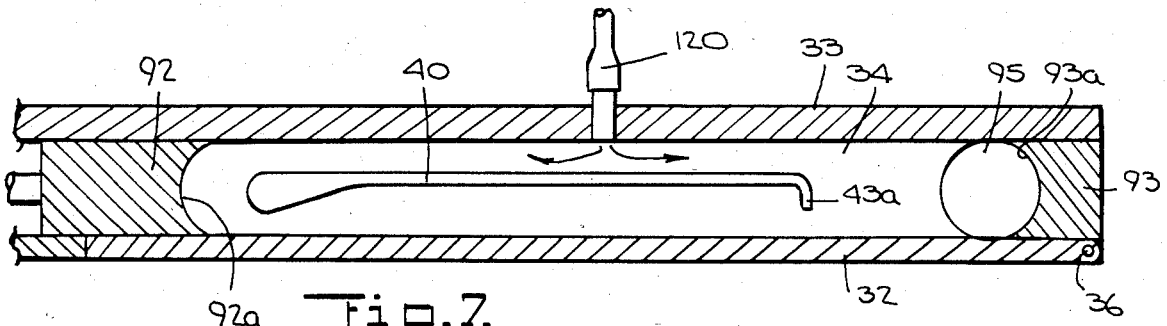
FIG. 7 is a top sectional view through the pouch deformation and insertion chamber showing the pouch after bursting and just prior to deformation.

An expandable pouch of the type described above is shown by reference numeral 40 just prior to insertion into the bursting chamber. Pouch 40 may be manually delivered to the bursting station or may be delivered by a suitable conveyor means, for example, as shown in the above-identified Ser. No. 570,376. Pouch 40 is received between rear guard plate 22 and movable bursting plate 24. Rear plate 22 extends above movable plate 24 by a specified distance, as shown, to facilitate proper insertion of pouch 40 between plates 22 and 24. As shown in FIGS. 4, 5 and 6 in sectional views, further provided is a U-shaped trough 25 which extends from plate 22 and which further faciliates insertion and guidance of the pouch 40. The lateral placement of trough 25 may be made adjustable via guiding shafts 27 to accommodate pouches of varying width. Movable bursting plate 24 moves rearwardly via the operation of suitable actuating means, such as air or hydraulic cylinders 28 or an electric motor, as shown in FIG. 3. Cylinder rods 26 of cylinders 28 are attached to bursting plate 24 and provide the necessary rearward motion. In FIG. 2, bursting plate 24 is shown cutaway so that pouch 40 can be seen in the bursting chamber. As shown in FIGS. 1 and 3, pouch 40 may comprise a folded-over flexible sheet product containing a two-part gas generating system. A first component of the system is contained in a first compartment 44 contained within the pouch, and a second component of the system is contained in a second separate compartment 46 of the pouch. The first component may be citric acid and the second component sodium bicarbonate, although other components may be used. Additional amounts of the first or another component may also be contained in a burstable compartment 42 of the pouch. When the pouch 40 is received within the bursting chamber defined by plates 22 and 24 and plate 24 is actuated, compartment 42 is ruptured, releasing the component contained therein so that it reacts with the first component contained in compartment 46, initiating the generation of pressurizing gas. As the gas pressure increases over time, after the pouch has been inserted into a container, additional amounts of the first component from compartment 44 are released. Compartment 44 is subdivided into a number of separated "demand release" cavities **44*a* so that additional quantities of the first component are released as required as the pouch 40 expands within a container to fill up space created by expulsion of fluid being dispensed. A separating seal 45 attaches the front and rear sides of the folded-over sheet product forming the pouch 40 together. As gas pressure in the pouch 40 increases, the seal 45 separates upwardly, causing the cavities 44*a*** to rupture as required depending on the demand for fluid being dispensed.

The operation of the bursting chamber will be explained in more detail with reference to FIGS. 3 through 6. As shown in FIG. 3, which is a rear view of the bursting chamber, pouch 40, shown cutaway, is received between plate 22 and movable actuator plate 24. Pouch 40 is prevented from falling further by a V-shaped latch member 60, which is reciprocably movable laterally with respect to plates 22 and 24, as shown by arrows 61. Prior to receipt of a pouch in the bursting chamber, V-shaped latch 60 is moved into the position shown by the solid lines so as to stop an entering pouch from falling out of the bursting chamber. V-shaped latch 60 may be driven via an air cylinder 62 which drives a cylinder rod 64 coupled to an adjustable clamp member 66, which is in turn coupled to latch 60 via a shaft 68. A limit switch 70 actuated via an adjustable cam 72 coupled to clamp 66, and which is adjustable via locking nut 74, is utilized to generate signals to control circuitry for the apparatus to indicate the position of latch 60. V-shaped latch 60 provides an improved means for holding pouch 40 between plates 22 and 24 and which lessens, to a large extent, undesirable folds or creases which may be imparted to the pouch 40 by other holding devices, such as a cylinder shaft or rod extending into the bursting chamber.

Once pouch 40 is received between plates 22 and 24 and is held in position by latch 60, plate 24 is actuated by air cylinders 28, and as shown in FIG. 4, compartment 42 containing one of the components of the gas generating system in pouch 40 is compressed, rupturing compartment 42 and allowing the component contained in that compartment to come into contact with the component contained in compartment 46. In order to enhance the initiation of the generation of gas, means preferably are provided so as to direct the component in compartment 42 towards compartment 46. These means include recesses 50 and 52 disposed on plates 22 and 24, respectively, preferably near the bottom edge of the two plates, as shown in FIG. 3. These recesses are shown in phantom in FIG. 3 and in sectional view in FIGS. 4, 5 and 6. Preferably, at least one of these recesses is located partially over the area of pouch 40 wherein compartment 42 is located, thus allowing the fluid in compartment 42, upon rupturing, to be directed into the recess and thus toward compartment 46.

Actuating plate 24 also includes a longitudinally extending recess 80 disposed at one side thereof. A matching projection 82 is also disposed on plate 22 and is received into recess 80 when plate 24 is actuated so as to move towards plate 22. As shown in FIG. 5, when plate 24 moves towards plate 22 to rupture compartment 42 to initiate the generation of gas in pouch 40, one side of pouch 40, preferably the side including the seam 43 attaching the two folded halves of the pouch 40 together, is bent into the recess 80. As will be explained in more detail with reference to FIGS. 7 through 10, this has the effect of facilitating, in a predictable and repeatable manner, the subsequent deformation of pouch 40 when the pouch 40 is deformed into an elongated shape so as to be received within the mouth of the container 150 to receive the pouch 40. As shown in FIG. 6, once cylinder 28 moves plate 24 away from plate 22, cylinder 62 is actuated so as to move latch 60 out of engagement with pouch 40, thereby allowing the pouch 40 to be received in the pouch deformation and insertion chamber 34 of the apparatus.

The pouch deformation and insertion station includes a chamber 34 into which the pouch is received, as shown in FIGS. 1 and 2. A sensor, not shown, for example a photosensor, may be provided so as to indicate to the control circuitry when a pouch is present within chamber 34. Upon receipt of a pouch in the chamber 34, actuators 90, for example, hydraulic or air cylinders, are actuated, forcing deforming block 92 to the right. Block 92 is threaded to the cylinder rods 94 of cylinders 90 and fastened via lock nuts 96 located in cut-outs 98 in block 92. As shown in FIGS. 7 through 10, which are sectional views through the pouch deformation and insertion station, the end of block 92 which comes into contact with pouch 40 has a concave surface **92*a* to facilitate the deformation of pouch 40. A limit switch 106 is provided and actuated by a cam 108 disposed on an extension 110 which is secured to block 92 at 112. Limit switch 106 provides a signal when block 92 has reached the rightmost limit of its travel while compressing pouch 40 into an elongated shape. A second limit switch 100 also may be provided, which is actuated by a cam 102 disposed on a shaft 104 secured to block 92 at 99. Switch 100 provides a signal when block 92** reaches the left most limit of its travel.

Figure 8:
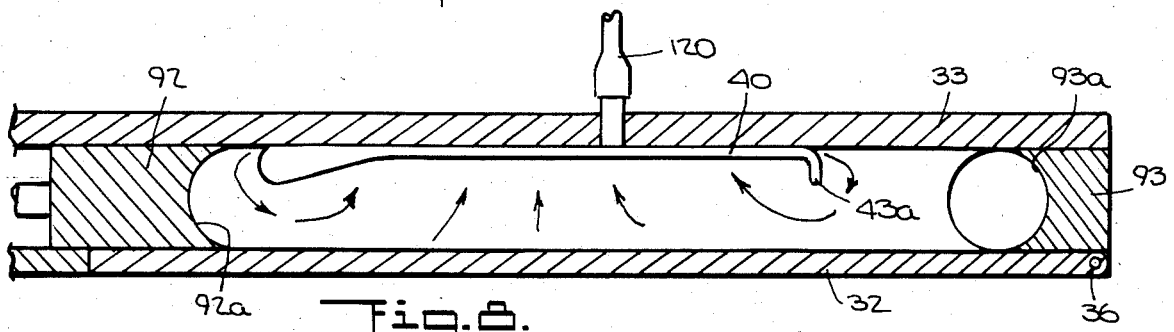
FIG. 8 is a view corresponding to FIG. 7 and shows how air pressure is used to orient the pouch in the pouch deformation and insertion chamber.

In order to provide that pouch 40 is properly deformed into an elongated shape so that it can be inserted into the relatively narrow mouth in the top of a container 150, it is preferable that the pouch 40 be forced toward the front or back surface of the chamber 34. In combination with the bend **43*a* at one edge of pouch 40 provided by projection 82 and recess 80 during the bursting operation, the movement of the pouch 40 toward, for example, the back side of chamber 34, as shown in FIG. 8, will facilitate further the proper deformation of pouch 40 into an elongated cylindrical shape. One way of accomplishing this is to provide an air pressure jet 120 in rear plate 33, which plate, in conjunction with front cover 32, defines the deformation and insertion chamber 34. It has been found that the provision of an air pressure jet 120 at approximately the center of the rear plate 33 will allow the air to circulate around the back of pouch 40 and toward the front surface of the pouch, as shown in FIG. 8, forcing substantial portions of the pouch 40 against the rear surface 33. Alternative methods might be to provide a vacuum jet in place of pressure jet 120, a plurality of vacuum jets along rear surface 33 or a plurality of pressure jets in front door 32, to attract or force the pouch 40 toward the rear surface. In practice, however, it has been found preferable to provide the single air pressure jet, as this provides the most convenient and inexpensive method for accomplishing the desired movement of pouch 40**.

Figure 9:
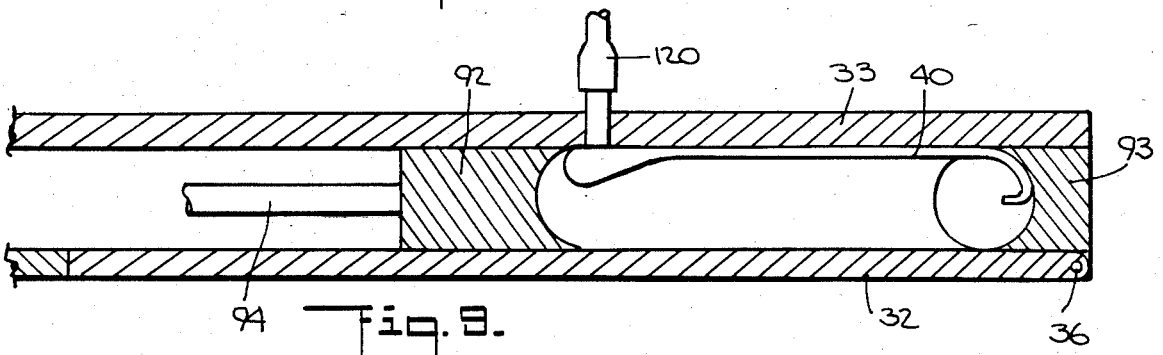
FIG. 9 is a view corresponding to FIGS. 7 and 8 showing the pouch during the process of deformation.
Figure 10:
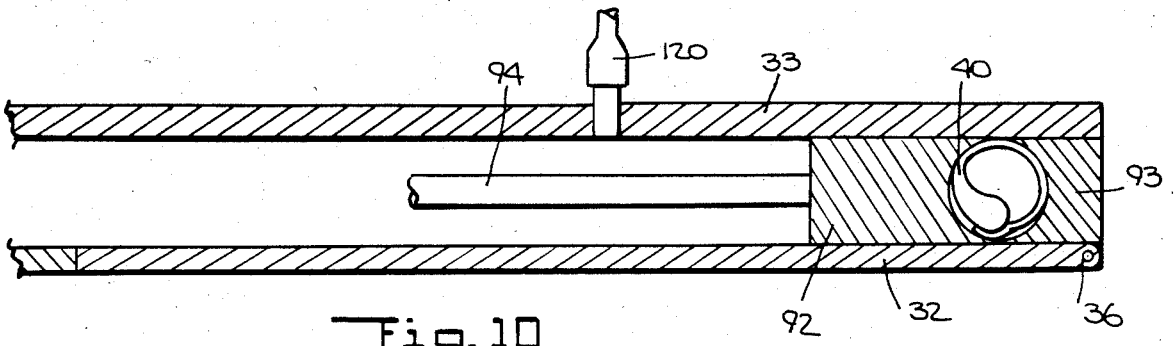
FIG. 10 is a view corresponding to FIGS. 7, 8 and 9 showing the deformed pouch just prior to insertion into a container.

While pouch 40 is disposed adjacent the rear surface 33, the cylinders 90 are actuated, forcing block 92 toward the right as shown in FIG. 9. Because of the fold at one end of pouch 40, pouch 40 will tend to form into a cylindrical shape as it is pressed against end block 93, which also has a concave inner surface **93*a*. Once block 92 has reached the limit of its travel, pouch 40 will have an approximately cylindrical shape defined by the concave surfaces of blocks 92 and 93, as shown in FIG. 10. At this point, a cylinder 130 disposed vertically above the bore 95 defined by the concave surfaces 92*a* and 93*a* of blocks 92 and 93 is actuated, forcing deformed elongated pouch 40 into a container 150 disposed on base 10 below a hole 37 in the bottom edge 35 defining the pouch deformation and insertion chamber 34. Base 10 preferably comprises a lifting pad 160, which may be actuated just prior to the time that cylinder 130 is actuated. Lifting pad 160 raises the container so that the open mouth 152 thereof is disposed adjacent the hole 37 in bottom plate 35. Lifting pad 160 may be actuated by suitable actuating means, such as an air or hydraulic cylinder or an electric motor. Also provided on base 10 are guide fingers 162 which are provided to properly position container 150. A thumb screw 164 may be provided to adjust the position of the fingers 162. Alternatively, as disclosed in the above-identified Ser. No. 570,376, other suitable means for positioning containers 150 below the pouch insertion and deformation chamber also may be provided. For example, a conveyor may be provided so as to automatically convey containers 150** into proper position, as disclosed in Ser. No. 570,376.

In order to provide for the insertion of pouches 40 into containers of varying height, an adjustable standard 170 may be provided for supporting the components of the apparatus on the base 10. The standard 170 may include a threaded shaft 172 and adjusting lock nut 174. In order to provide sufficient supporting strength, mating members 174 and 176 may be provided which are closely received within each other, as shown in FIGS. 1 and 2.

Control circuitry and air pressure regulating means, if air cylinders are used as the actuating means for the various components of the apparatus, may be housed within base 10. For example, a start button 190, reset button 192, emergency stop button 194, air pressure regulator 196 for cylinders 90, air pressure regulator 197 for cylinders 28 and main air supply pressure regulator 198 may be provided.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than a restricted sense.

What is claimed is:

1. Apparatus for inserting flexible sheet products into containers, each of said products comprising an expandable pouch for pressurizing a container, said pouch including burstable means for generating pressurizing gas within said pouch, said apparatus comprising:

first plate means;

second plate means extending parallel to and adjacent said first plate means and spaced apart therefrom, said sheet product being received between said first and second plate means;

actuating means for relatively moving said first and second plate means toward each other so as to compress said flexible sheet product to burst said burstable means;

means for deforming said sheet product into an elongate shape, said means for deforming comprising means having a generally flat internal chamber for receiving said flexible sheet product from said first and second plate means defined by first and second opposing surfaces and first and second ends, and pusher means mounted in said chamber extending along said first end, means for moving said pusher means laterally toward and away from the second end, for deforming said flexible sheet product in said chamber into an elongate folded sheet product extending along and against the second end, said generally flat internal chamber having means for moving said flexible sheet product substantially against one of said opposing surfaces and spaced away from the other of said surfaces of said chamber while said pusher means deforms said flexible sheet product to thereby guide said sheet as it is deformed; and means for inserting said deformed sheet product into the container from said chamber.

2. The apparatus recited in claim 1, wherein said means for inserting comprises ejector means movable in said chamber along the second end for endwise ejection of the folded sheet product into the container and said actuating means comprises cylinder means.

3. The apparatus recited in claim 1, wherein said means for moving said sheet product against a surface of said chamber comprises fluid jet means for forcing said sheet product against said surface.

4. The apparatus recited in claim 3, wherein said fluid jet means comprises air pressure jet means disposed at the approximate center of a surface of said chamber.

5. The apparatus recited in claim 1, further comprising means for directing fluid contained within said burstable means in a predetermined direction in said pouch when said burstable means is ruptured by said first and second plate means.

6. The apparatus recited in claim 5, wherein said means for directing fluid contained within said burstable means comprises recess means disposed in alignment with part of said burstable means of said pouch on an inner surface of at least one of said first and second plate means, said recess means being arranged so that fluid contained within said burstable means is forced into said recess means when said first and second plate means relatively move toward each other, the fluid in said burstable means thereby being directed in a predetermined direction in said pouch.

7. The apparatus recited in claim 6, wherein said recess means are provided on both said first and second plate means.

8. The apparatus recited in claim 1, further comprising means for bending an edge of a pouch to thereby facilitate subsequent deformation of said pouch into an elongate shape.

9. The apparatus recited in claim 1, wherein one of said first and second plate means includes a longitudinally extending recess means, and the other of said plate means comprises a longitudinally extending projecting means, said projecting means being received within said longitudinally extending recess means in the other plate means when said two plate means relatively move toward each other, said projecting means forcing an edge of a pouch received between said first and second plate means into said recess means, thereby bending the edge of said pouch to facilitate subsequent deformation of said pouch into an elongate shape.

10. The apparatus recited in claim 1, further comprising means for holding said pouch between said first and second plate means.

11. The apparatus recited in claim 10, wherein said holding means comprises latch means laterally reciprocably movable into and out of a space adjacent a bottom edge of said first and second plate means, said latch means having a V-shaped slot therein for receiving a lower edge of said pouch and thereby holding said pouch in an area between said first and second plate means when said first and second plate means relatively move toward each other, said latch means being movable away from said first and second plate means after said first and second plate means have moved away from each other to thereby allow said pouch to fall out of the area between said first and second plate means.

12. The apparatus recited in claim 11, further comprising actuator means for reciprocably moving said latch means.

13. Apparatus for inserting flexible sheet products into containers, each of said products comprising an expandable pouch for pressurizing a container, said pouch including burstable means for generating pressurizing gas within said pouch, said apparatus comprising:

first plate means;

second plate means extending parallel to and adjacent said first plate means and spaced apart therefrom, said sheet product being received between said first and second plate means;

actuating means for relatively moving said first and second plate means toward each other so as to compress said flexible sheet product to burst said burstable means;

means for bending an edge of said flexible sheet product comprising cooperative recess and projecting means disposed on respective ones of said first and second plate means, said projecting means forcing said edge of said pouch received between said first and second plate means into said recess means as said actuating means moves said first and second plate means relatively toward each other, thereby bending the edge of said pouch so as to facilitate subsequent deformation of said sheet product into an elongate shape;

means for deforming said sheet product into an elongate shape, said means for deforming comprising means having a generally flat internal chamber for receiving said flexible sheet product from said first and second plate means defined by first and second opposing surfaces and first and second ends, said bent edge being received at the second and of said chamber, and pusher means mounted in said chamber extending along said first end, means for moving said pusher means laterally toward and away from said second end for moving the bent edge into contact with said second end and continuing to press said sheet against said second and thereby deforming said flexible sheet product in said chamber into an elongate folded sheet product extending along said second end; and means for inserting said deformed sheet product into said container from said chamber.

14. The apparatus recited in claim 13, wherein said means for inserting comprises ejector means movable in said chamber along the second end for endwise ejection of the folded sheet product into the container and said actuating means comprises cylinder means.

15. The apparatus recited in claim 13, further comprising means for moving said flexible sheet product toward one of said opposing surfaces of said chamber while said pusher means deforms said flexible sheet product.

16. The apparatus recited in claim 15, wherein said means for moving said sheet product against a surface of said chamber comprises fluid jet means for forcing said sheet product against said surface.

17. The apparatus recited in claim 16, wherein said fluid jet means comprises air pressure jet means disposed at the approximate center of a surface of said chamber.

18. The apparatus recited in claim 13, further comprising means for directing fluid contained within said burstable means in a predetermined direction in said pouch when said burstable means is ruptured by said first and second plate means.

19. The apparatus recited in claim 18, wherein said means for directing fluid contained within said burstable means comprises recess means disposed in alignment with part of said burstable means of said pouch on an inner surface of at least one of said first and second plate means, said recess means being arranged so that fluid contained within said burstable means is forced into said recess means when said first and second plate means relatively move toward each other, the fluid in said burstable means thereby being directed in a predetermined direction in said pouch.

20. The apparatus recited in claim 19, wherein said recess means are provided on both said first and second plate means.

21. The apparatus recited in claim 13, wherein said means for bending is disposed on at least one of said first and second plate means.

22. The apparatus recited in claim 21, wherein said, cooperative recess and projecting means comprises a longitudinally extending recess means provided on one of said first and second plate means, and a longitudinally extending projecting means provided on the other of said plate means.

23. The apparatus recited in claim 13, further comprising means for holding said pouch between said first and second plate means.

24. The apparatus recited in claim 23, wherein said holding means comprises latch means laterally reciprocably movable into and out of a space adjacent a bottom edge of said first and second plate means, said latch means having a V-shaped slot therein for receiving a lower edge of said pouch and thereby holding said pouch in an area between said first and second plate means when said first and second plate means relatively move toward each other, said latch means being movable away from said first and second plate means after said first and second plate means have moved away from each other to thereby allow said pouch to fall out of the area between said first and second plate means.

25. The apparatus recited in claim 24, further comprising actuating means for reciprocably moving said latch means.

26. Apparatus for inserting flexible sheet products into containers, each of said products comprising an expandable pouch for pressurizing a container, said pouch including burstable means for generating pressurizing gas within said pouch, said apparatus comprising:

first plate means;

second plate means extending parallel to and adjacent said first plate means and spaced apart therefrom, said sheet product being received between said first and second plate means;

actuating means for relatively moving said first and second plate means toward each other so as to compress said flexible sheet product to burst said burstable means;

means for holding said pouch between said first and second plate means comprising latch means reciprocably movable into and out of a space adjacent a bottom edge of said first and second plate means, said latch means having a V-shaped slot therein for receiving a lower edge of said pouch and thereby holding said pouch in an area between said first and second plate means when said first and second plate means relatively move toward each other, means for moving said latch means away from said first and second plate means after said first and second plate means have moved away from each other to thereby allow said pouch to fall out of the area between said first and second plate means;

means for deforming said sheet product into an elongate shape, said means for deforming comprising means having a generally flat internal chamber for receiving said flexible sheet product from said first and second plate means defined by first and second opposing surfaces and first and second ends, and pusher means mounted in the chamber extending along said first end, means for moving said pusher means laterally toward and away from said second end, for deforming said flexible sheet product in said chamber into an elongate folded sheet product extending along and against said second end; and means for inserting said deformed sheet product into the container from said chamber.

27. The apparatus recited in claim 26, wherein said means for inserting comprises ejector means movable in said chamber along the second end for endwise ejection of the folded sheet product into the container and said actuating means comprises cylinder means.

28. The apparatus recited in claim 26, further comprising means for moving said flexible sheet product toward one of said opposing surfaces of said chamber while said pusher means deforms said flexible sheet product.

29. The apparatus recited in claim 28, wherein said means for moving said sheet product against a surface of said chamber comprises fluid jet means for forcing said sheet product against said surface.

30. The apparatus recited in claim 29, wherein said fluid jet means comprises air pressure jet means disposed at the approximate center of a surface of said chamber.

31. The apparatus recited in claim 26, further comprising means for directing fluid contained within said burstable means in a predetermined direction in said pouch when said burstable means is ruptured by said first and second plate means.

32. The apparatus recited in claim 31, wherein said means for directing fluid contained within said burstable means comprises recess means disposed in alignment with part of said burstable means of said pouch on an inner surface of at least one of said first and second plate means, said recess means being arranged so that fluid contained within said burstable means is forced into said recess means when said first and second plate means relatively move toward each other, the fluid in said burstable means thereby being directed in a predetermined direction in said pouch.

33. The apparatus as recited in claim 32, wherein said recess means are provided on both said first and second plate means.

34. The apparatus recited in claim 26, further comprising means for bending an edge of a pouch to thereby facilitate subsequent deformation of said pouch into an elongate shape.

35. The apparatus recited in claim 26, wherein one of said first and second plate means includes a longitudinally extending recess means, and the other of said plate means comprises a longitudinally extending projecting means, said projecting means being received within said longitudinally extending recess means in the other plate means when said two plate means relatively move toward each other, said projecting means forcing an edge of a pouch received between said first and second plate means into said recess means, thereby bending the edge of said pouch to facilitate subsequent deformation of said pouch into an elongate shape.

36. The apparatus recited in claim 26, further comprising actuator means for reciprocably moving said latch means.

* * * * *

UNITED STATES PATENT AND TRADEMARK OFFICE

CERTIFICATE OF CORRECTION

PATENT NO. : 4,594,834

DATED : June 17, 1986

INVENTOR(S) : Richard Schmidt, and Joseph A. Pizzo, Sr.

It is certified that error appears in the above-identified patent and that said Letters Patent is hereby corrected as shown below:

In the Claims:

Col. 9, line 20, change "and" to --end--.

Col. 9, line 26, change "and" to --end--.

Signed and Sealed this

Third Day of February, 1987

*Attest:*

DONALD J. QUIGG

*Attesting Officer*

*Commissioner of Patents and Trademarks*